US006276380B1

(12) United States Patent
Okuda

(10) Patent No.: US 6,276,380 B1
(45) Date of Patent: Aug. 21, 2001

(54) ANTI-WIND UMBRELLAS

(76) Inventor: Toshio Okuda, 4-3, 1-Chome Sugi, Hirakata City, Osaka (JP)

( * ) Notice: Subject to any disclaimer, the term of this patent is extended or adjusted under 35 U.S.C. 154(b) by 0 days.

(21) Appl. No.: 09/516,223

(22) Filed: Mar. 1, 2000

(51) Int. Cl.[7] ..... A45B 25/20
(52) U.S. Cl. ..... 135/33.7; 135/31; 135/33.2
(58) Field of Search ..... 135/38–41, 33.2, 135/33.7, 29, 31

(56) References Cited

U.S. PATENT DOCUMENTS 4,934,394 * 6/1990 Hermanson ..... 135/38
6,006,770 * 12/1999 Lin ..... 135/33.7
6,173,724 * 1/2001 You ..... 135/33.7

* cited by examiner

*Primary Examiner*—Beth A. Stephan
(74) *Attorney, Agent, or Firm*—Bacon & Thomas PLLC

(57) ABSTRACT

A wind-resistant umbrella. The wind-resistant umbrella includes a holder cord (8) that is arranged offset with the stretcher (3) so that the cord (8) does not contact with the stretcher (3), thus avoiding any friction that may occur on an interface therebetween during the closing or opening of the umbrella. The wind-resistant umbrella includes an upper catch (10) that is selectable from designs that vary in resistance to wind. The wind-resistant umbrella includes a runner (4) having an enlarged pushing body (14) provided with guide grooves (18, 18') that allow the runner (4) to pass therethrough downwardly along the shaft (1), thereby preventing the runner (4) from hitting against the upper catch (10).

4 Claims, 5 Drawing Sheets

FIG. 6
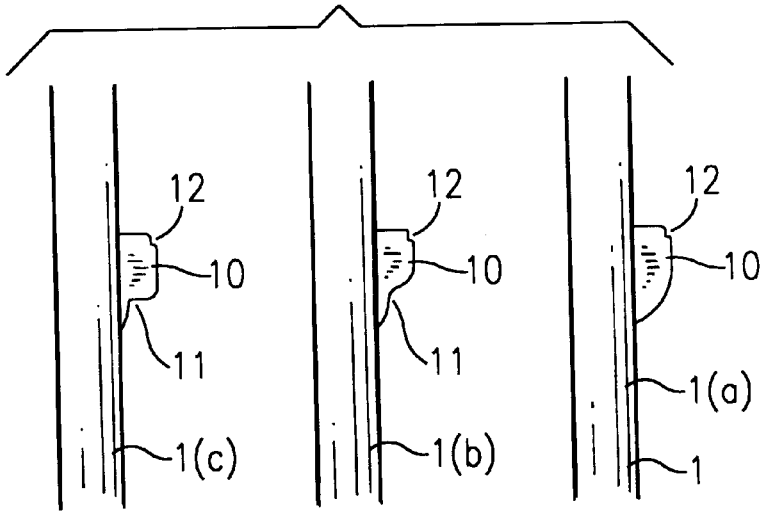
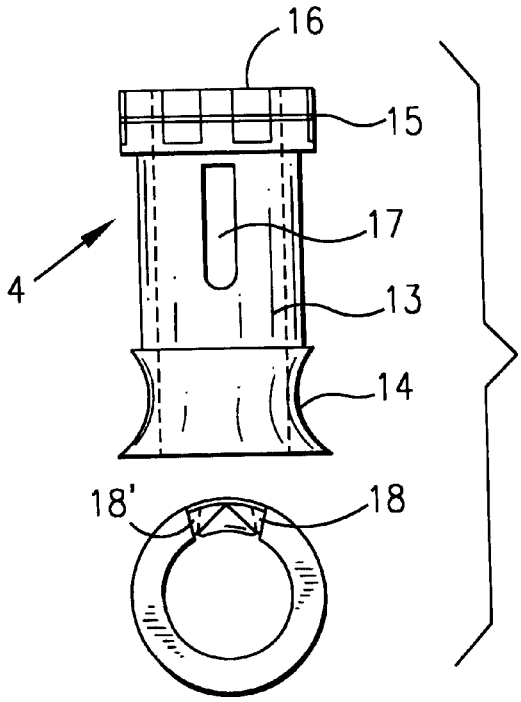
FIG. 7

ANTI-WIND UMBRELLAS

BACKGROUND OF THE INVENTION

1. Field of the Invention

The inventive device relates to special kinds of umbrella that can cope with strong wind.

2. Description of the Related Art

It is known that there has been a kind of umbrella which is designed to allow its cover to be inverted upward when a strong wind acts thereon and the umbrella is restored to its normally closed condition by simply pulling the runner downwardly along the shaft.

This kind of umbrella is sold under the trademark "WINDFLEX umbrella" in the market place.

There is another kind of umbrella which is designed to prevent its cover from being inverted even when a strong wind acts thereon. Such umbrella is generally sold under the trademark "WINDLOCK umbrella".

The schematic representation of the aforesaid WINDFLEX umbrella and WINDLOCK umbrella are exhibited in FIG. 1 and FIG. 2, respectively.

One shortcoming of the WINDFLEX umbrella is that its cover is easily inverted, whereas in the WINDLOCK umbrella a strong friction occurs, as shown in FIG. 2, along the contacting faces between its holder cords (D-E) and stretchers (B-C) when opening and closing the umbrella, due to the arrangement of all points A, B, C and E being on the same plane.

SUMMARY OF THE INVENTION

It is therefore an object of the present invention to provide improved versions of both the WINDFLEX and WINDLOCK type umbrellas to eliminate the above mentioned shortcomings.

Another object of the invention is to provide a new model of a runner and a catch for umbrellas of the type having a cover attached to a shaft by means of a stretcher and rib arrangement and a spring loaded upper catch on the shaft for securing the umbrella in its open position on the runner.

The invention will now be described with reference to the accompanying drawings wherein the same numeral represents the same element throughout the text.

BRIEF DESCRIPTION OF THE DRAWINGS

FIG. 6 shows different designs of spring loaded upper catches;

FIG. 7 is front and bottom views of the runner of the invention; and

DETAILED DESCRIPTION OF THE PREFERRED EMBODIMENTS

Figure 2:
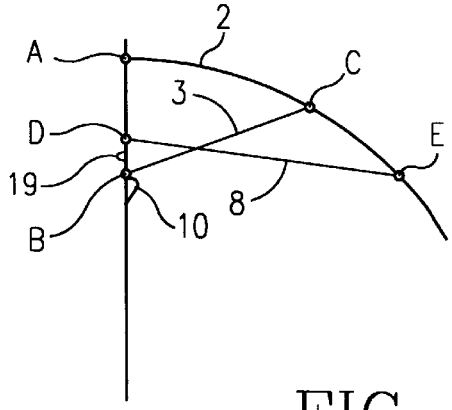
FIG. 2 PRIOR ART
FIG. 2 is a partial front view of the WINDLOCK umbrella of the prior art in the open position.
Figure 3A:
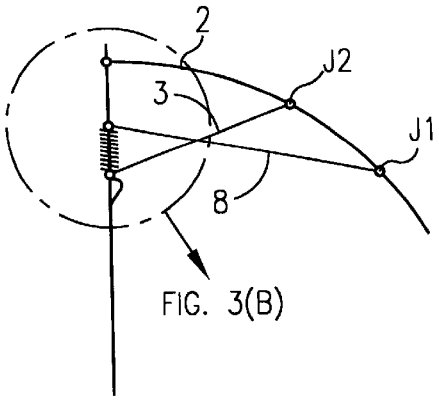
FIG. 3(A) is a partial front view of the umbrella of the invention in the open position.
Figure 3B:
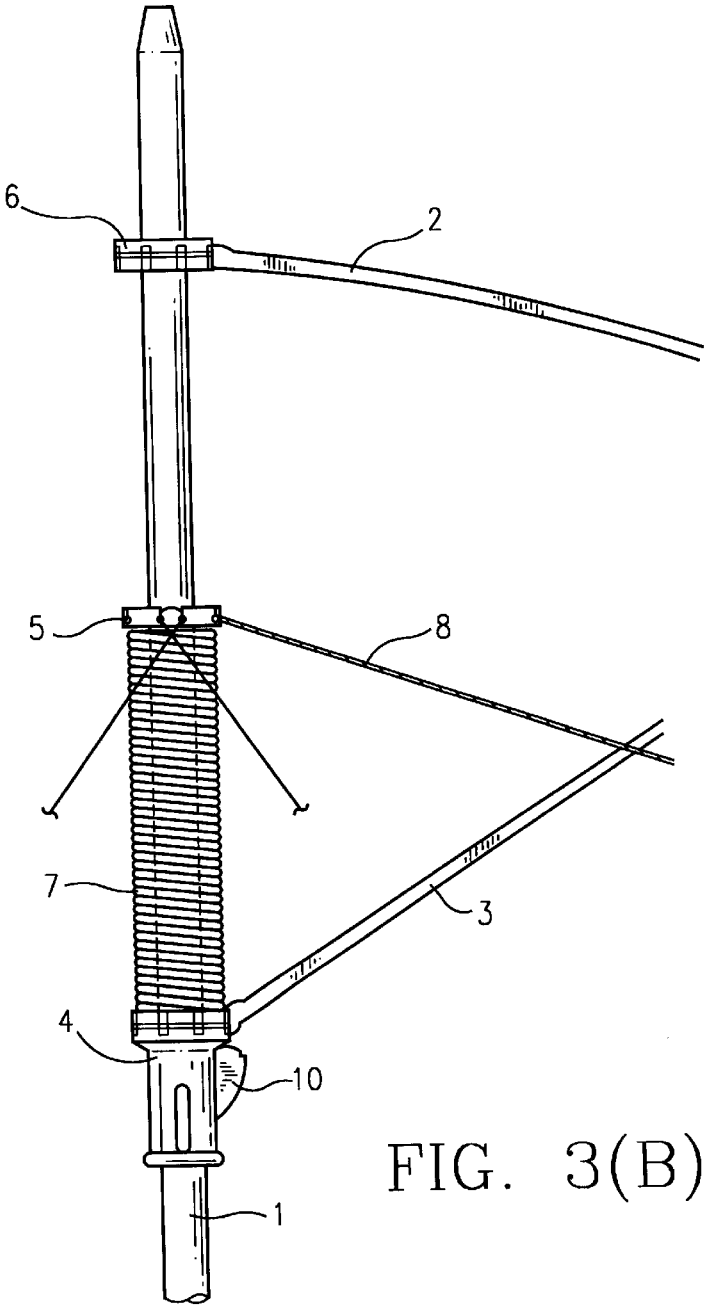
FIG. 3(B) is an enlarged view of the encircled portion of FIG. 3(A)

Referring to FIG. 2 and FIG. 3, the umbrella of this invention typically comprises an umbrella shaft 1 which may or may not be telescopically foldable, and a cover (not shown) which is supported by a rib 2 in a stretcher arrangement which enables it to be folded and unfolded. The arrangement includes a number of stretchers 3, usually six or eight, which are attached to the main body of a runner 4 which is slidable up and down the shaft to open and close the umbrella. In the invention, an autorunner 5 formed of a substantially rigid ring is moveably provided on the shaft 1 between a crown 6 and a coil spring 7.

Figure 1A:
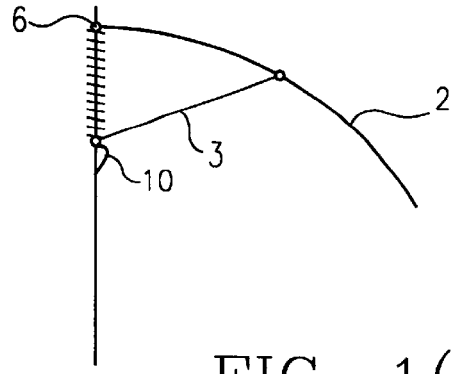
FIG. 1(A) PRIOR ART
FIG. 1(A) is a partial front view of the WINDFLEX umbrella of the prior art in the open position.
Figure 1B:
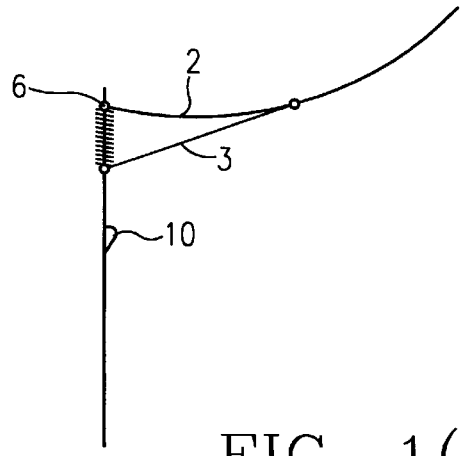
FIG. 1(B) PRIOR ART
FIG. 1(B) is the umbrella of the FIG. 1(A) in the turned over position.
Figure 5:
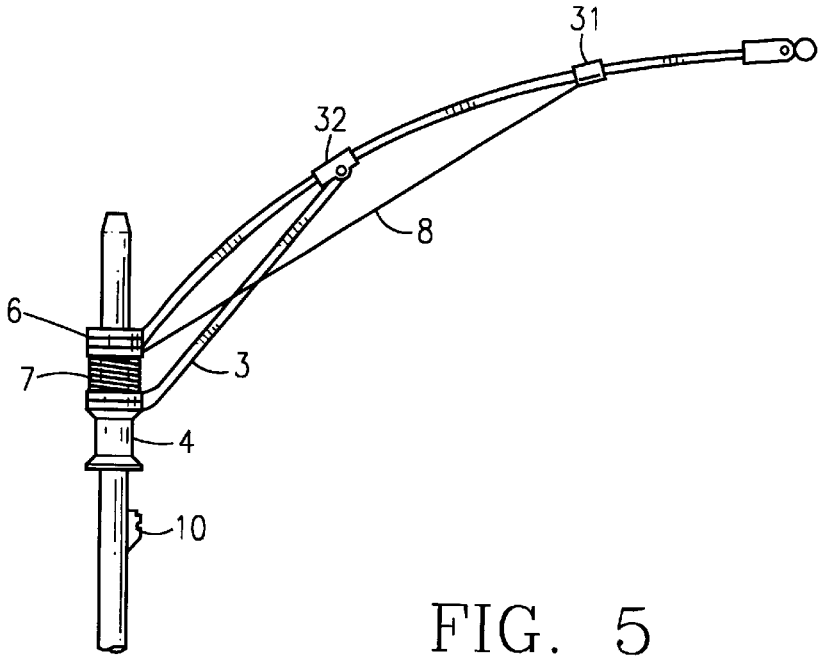
FIG. 5 is a partial front view of the umbrella of the invention in the turned over position.

A joint J1 is fixed at the intermediate portion on a rib 2 between a tip 9 and a joint J2. A holder cord 8 is fixed between the autorunner 5 and the joint J1. The holder cord 8 may be formed of a rigid material such as a steel wire or a strong flexible cord made of synthetic fiber. The stretcher 3 is pivoted to a runner 4, the outer end of which is pivotally connected to the joint J2. The above described arrangement structure provides an improved wind resistance over the prior art WINDFLEX umbrella illustrated in FIG. 1. However, when the wind is extremely strong, the cover (not shown) together with the runner 4 would be blown upward and turned inside out as illustrated in FIG. 5, but may easily be brought back to its normally closed condition by simply pulling down the runner 4.

The strength of resistance to the wind can be controlled by modifying the shape of an upper catch 10. Shown in FIG. 6 are three different shapes of the upper catch. It is observed that as the cover is blown upward by the strong wind, the runner 4 also slides upward over the upper catch 10 as shown in FIG. 5, By virtue of changing the shape of the upper catch, the power to resist the wind can considerably be controlled. Referring now to FIG. 6, where reference element 1(*a*) includes an upper catch for a "Mild" setting, reference element 1(*b*) includes an upper catch for a "Medium" setting and reference element 1(*c*) includes an upper catch for a "Full-lock" setting gradations of power to resist the wind, by the shape of the upper catch. As can be seen from the drawings, reference elements 1(*b*) and 1(*c*) are each formed with a concave 11 at the lower side thereof, whereas none of such concave is formed on reference element 1(*a*) at the corresponding portion.

Figure 4:
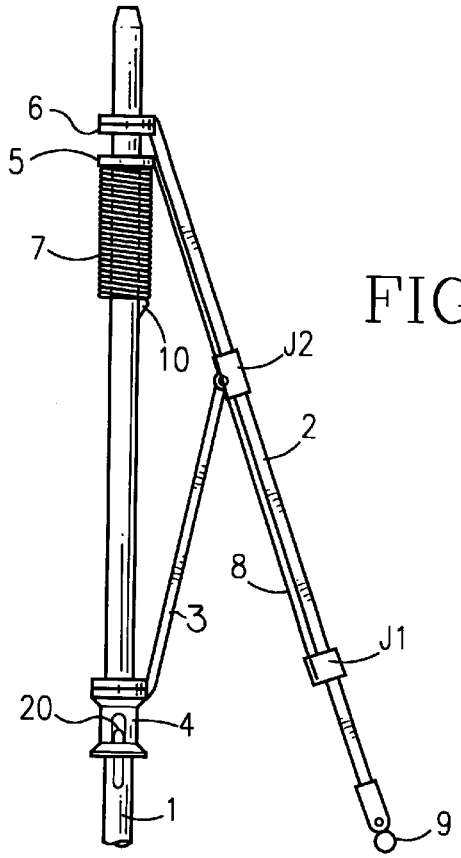
FIG. 4 is a partial front view of the umbrella of the invention in the half-closed position.

The concave 11 formed at the lower portion of the upper catch 10 serves to prevent the bottom of runner 4 from going up, functioning at Full-Lock or Medium Lock settings, whereas the concave 12 formed on the top and middle portion of each catch serves to stop or catch the lower end of the coil spring 7 as the runner 4 slides down along the shaft 1 to close the umbrella (refer to FIG. 4).

Figure 8:
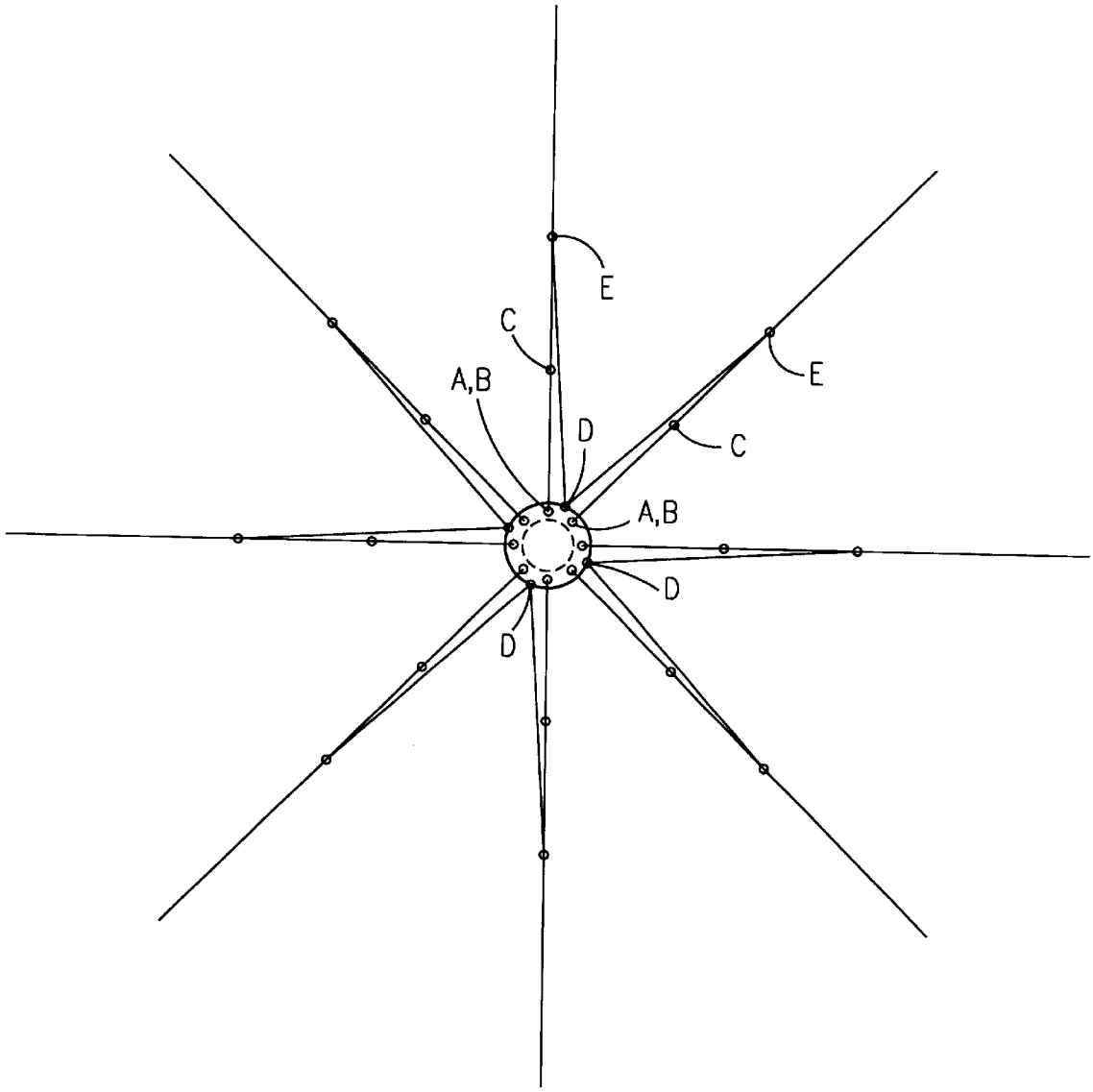
FIG. 8 is a schematic view showing the arrangement of the holder cords and stretchers of the invention.

The holder cord 8, in accordance with the invention, as illustrated in FIG. 8, is fixed in such a manner that the D-E line (cord 8) does not contact with the B-C line (stretcher 3) and thereby avoiding any friction occuring on their interface.

Further, in accordance with the invention there is provided a new model of a runner which will not trap or pinch a user's fingers between the runner 4 and the upper catch 10 when the runner 4 is returning from the turned out position to the normally closed position, particularly if the coil spring 7 is strong.

As detailed in FIG. 7, the improved runner 4 of the invention comprising a main body 13 and an enlarged pushing body 14, said main body 13 having a cylindrical sleeve section and a radially extending flanged portion in which a perimeter of said flanged portion is provided with a wire receiving groove 15 and a plurality of tine receiving slots 16 are located around the circumference of the flanged portion, the pushing body 14 defining a grip for user and having two longitudinal slots 17 for respectively receiving the upper catch 10 and a lower catch 20 (see FIG. 4), and guide grooves 18,18' serving as sideways to allow the runner 4 passing there-through downwardly along the shaft 1 to thereby avoid hitting against the upper catch 10.

In accordance with the invention following advantages may be achieved:

1. One umbrella can be made as either WINDFLEX or WINDLOCK by simply changing the upper catch 10 as needed;
2. D-E line (cord 8) and B-C line (stretcher 3) will not contact and rub each other as is the case in the prior art;
3. Power to resist the wind can be controlled by the shape of the upper catch 10 (of reference element 1(*a*), 1(*b*) and 1(*c*) in FIG. 6);
4. The upper catch 10 eliminates the stopper rivet 19 for the runner on the shaft (shown in FIG. 2); and
5. The runner 4 (shown in FIG. 7) can slide down automatically along the shaft after the cover gets inverted and passes through the upper catch 10 without hitting against or resting on the top of the upper catch.

What is claimed is:

1. In an anti-wind umbrella having a cover attached to a shaft (1) by a stretcher (3) and a rib (2), a spring loaded upper catch (10) positioned on the shaft (1) for securing the umbrella in an open position on a runner (4), an autorunner (5) movably provided on the shaft (1) between a crown (6) and a coil spring (7), the coil spring (7) and the autorunner (5) positioned on the shaft (1) between the runner (4) and the crown (6), a holder cord (8) fixed to the autorunner (5) and a joint (J1) which is fixed at an intermediate portion of the rib (2) between a tip (9) and a joint (J2) to which the stretcher (3) that is connected to the runner (4) is fixed, wherein the improvement comprises:

(a) the holder cord (8) being arranged offset to the stretcher (3) in such a manner that the cord (8) does not contact with the stretcher (3) and thus avoiding any friction that may occur on an interface between the holder cord (8) and the stretcher (3) when closing or opening the umbrella;

(b) the upper catch 10 is selectable from designs that vary in their resistance to wind; and (c) the runner (4) having an enlarged pushing body (14) provided with guide grooves (18, 18') that allow the runner (4) passing therethrough downwardly along the shaft (1) preventing the runner (4) from hitting against the upper catch (10).

2. The anti-wind umbrella according to claim 1, wherein the upper catch (10) is provided with a first concave (11) at its lower portion and a second concave (12) at its upper portion.

3. The anti-wind umbrella according to claim 2, wherein the first concave (11) serves to prevent the bottom of the runner (4) from going up, functioning as a full-lock or medium lock, whereas the second concave (12) serves to stop the lower end of the coil spring (7) when the runner (4) slides down the shaft to close the umbrella.

4. The anti-wind umbrella according to any one of claims 1 to 3, in which the holder cord (8) is a strong flexible cord made of synthetic fiber.

* * * * *